United States Patent [19]

Kenworthy et al.

[11] Patent Number: 4,666,390

[45] Date of Patent: May 19, 1987

[54] APPARATUS FOR MAKING A PATTERNED NON-WOVEN FABRIC

[75] Inventors: Ian C. Kenworthy; Robert B. Gettins; Peter W. Logan, all of Duns, Scotland; Patrick Jeambar, Pontcharra; Andre Vuillaume, St. Ismier, both of France

[73] Assignee: The Dexter Corporation, Windsor Locks, Conn.

[21] Appl. No.: 789,551

[22] Filed: Oct. 21, 1985

Related U.S. Application Data

[63] Continuation of Ser. No. 438,853, Oct. 22, 1982, Pat. No. 4,582,666.

[30] Foreign Application Priority Data

Feb. 2, 1981 [GB] United Kingdom ..... 8106175

[51] Int. Cl.[4] ..... D21F 11/00

[52] U.S. Cl. ..... 425/86; 425/388

[58] Field of Search ..... 264/546, 557, 555, 570, 264/571; 426/77; 28/104, 105; 83/861, 22, 177; 425/86, 387.1, 388

[56] References Cited

U.S. PATENT DOCUMENTS

| | | | |
|---|---|---|---|
| 2,862,251 | 12/1958 | Kalwaites | 162/286 |
| 3,284,857 | 11/1966 | Haynek | 264/546 |
| 3,353,225 | 11/1967 | Dodson, Jr. et al. | 28/104 |
| 3,403,862 | 10/1968 | Dworjanyn | 28/104 |
| 3,485,706 | 12/1969 | Evans | 162/115 |
| 4,024,612 | 5/1977 | Contractor | 28/105 |

FOREIGN PATENT DOCUMENTS 1326915 8/1973 United Kingdom .

*Primary Examiner*—Tim Miles

*Attorney, Agent, or Firm*—Chilton, Alix & Van Kirk

[57] ABSTRACT

A non-woven fabric having a pattern defined by an array of discrete areas having a reduced fibre density but which are substantially free of peforations is produced by supporting a freshly wet laid web of the non-woven fabric on a porous surface and directing spaced jets of fluid against the unsupported side in order to displace fibres within discrete areas while maintaining in position a proportion of fibres that are within those areas and that are adjacent the porous surface. The fabric web may be supported on a Fourdrinier wire (1) and the jets of fluid (e.g. water) may be directed through the apertures in a perforated cylinder (6), the fluid being supplied under pressure from a water-knife device (11). The apertures in the cylinder (6) preferably have a cross-section that increases in the direction of the water jets. Vacuum may be applied through the Fourdrinier wire (1) by means of a vacuum box (10) and vacuum may also be applied within the cylinder (6) from means (17) in order to remove excess water from within the cylinder (6).

13 Claims, 9 Drawing Figures

FIG. 1.
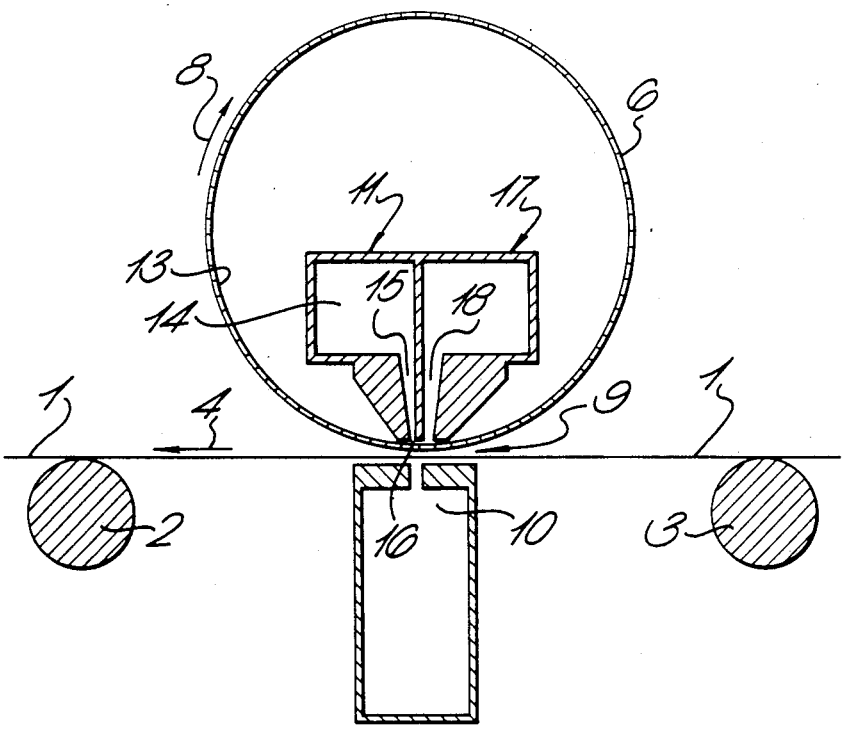
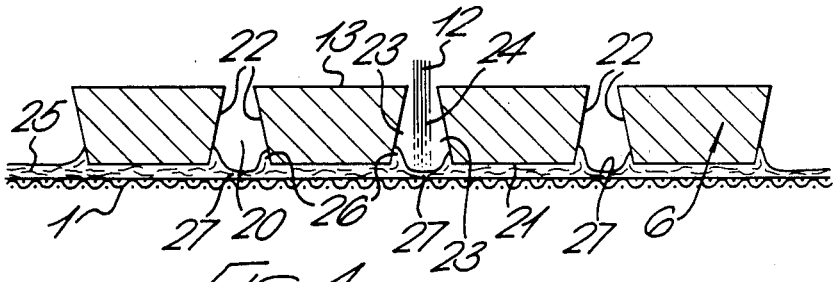
FIG. 4.

APPARATUS FOR MAKING A PATTERNED NON-WOVEN FABRIC

This is a continuation of co-pending application Ser. No. 438,853 filed on Oct. 22, 1982, now U.S. Pat. No. 4,582,666.

FIELD OF THE INVENTION

This invention relates to a method and apparatus for making patterned non-woven fabrics, for example paper for the manufacture of infusion pouches.

BACKGROUND OF THE INVENTION

Infusion pouches, for example teabags and spice-bags are commonly formed as pouches of a non-woven material (referred to hereinafter as "teabag paper") that is permeable to water and to the beverage formed by infusion, i.e. by the dissolution of soluble solids in the contents of the pouch, upon the application of hot water thereto.

Teabag paper is generally a non-woven web of a light weight permeable fibrous material made, for example, from abaca pulp, sisal pulp, regenerated rayon, esparto grass pulp, long-fibred chemical wood pulp or mixtures thereof. In order to permit the fabrication of a heat-sealed pouch, the fibrous material may comprise heat-sealable fibres such as polyolefins, e.g. polyethylene or polypropylene, or vinyl chloride and vinyl acetate polymers or copolymers. The heat-sealable fibres may constitute a discrete phase on, for example, a cellulosic base phase.

Teabag paper is currently available in two types. One is a plain, non-woven web which is made on an ordinary Fourdrinier wire. The other type is a patterned web, the pattern being formed by an array of discrete areas having a lower fibre density than that of the rest of the web.

Teabag paper of the second type is formed on a wire having pronounced knuckles, as described in British Patent Specification No. 1,102,246. However, in the course of manufacturing the web, the knuckles of the wire often break through the web and give rise to clear holes of the size of the knuckle.

It is also known that perforated or reticulated non-woven materials can be produced by forming a wet-laid web, supporting this on a perforated screen and forcing jets of fluid through the supported web. Such techniques are disclosed in British Patent Specifications No. 836,397 and No. 1,326,915 and U.S. Pat. No. 3,485,706.

To be completely acceptable, teabag paper must possess characteristics such as cleanliness, good absorbency, high wet strength and a sheet structure that permits rapid permeation of the beveravage; it is also found that many consumers have a preference for teabags formed from paper having a pattern thereon. However, it is also important that the paper should not sift, that is it should prevent the passage therethrough of fine particles ("dust") of the tea or other solids contained in the bag or pouch. Clearly, however, the presence of clear holes in the web will cause sifting of the web. If one surveys the filtering media produced by prior-art methods, it is found that they fall within the following categories: (i) products with a good pattern difinition but poor dust-retention properties, (ii) products with good dust-retention properties but a poorly defined pattern and (iii) products with mediocre pattern definition and mediocre dust-retention properties.

Accordingly, there is a definite need for a patterned or decorative filter medium having a good pattern definition coupled with good filtration or sifting characteristics.

In the following text, the invention will be discussed primarily in terms of teabag paper; however, it should be understood that the invention can be applied to other non-woven filtration media, for example non-woven fabrics used in surgical face masks, coffee filters and the like.

SUMMARY OF THE INVENTION

The present invention provides a method of producing a patterned non-woven fabric, which method comprises supporting a web of a non-woven fabric against a porous surface; overlaying at least part of the supported web with an apertured member having a first surface adjacent the web and a second surface remote from the web, the first surface having apertures therein each communicating with a respective aperture in the second surface by means of a passageway extending therebetween; and causing discrete streams of fluid to impinge upon the side of the web remote from the porous surface, characterised in that each stream passes through a respective passageway and has a cross-section smaller in area than the area of the respective aperture in the first surface of the apertured member.

The invention also provides an apparatus for producing a patterned non-woven fabric, which apparatus comprises means defining a porous surface for supporting a non-woven web; an apertured member having a first surface adjacent the porous surface and a second surface remote from the porous surface, the first surface having apertures therein each communicating with a respective aperture in the second surface by means of a passageway extending therebetween; and means for supplying fluid to passageways in the apertured member to form a stream of fluid in each of those passageways in the direction from the second surface to the first surface, characterised by an arrangement such that the streams of fluid each have a cross-section smaller in area than the area of the respective aperture in the first surface of the apertured member.

The streams of fluid that impinge on the web act to displace fibres from discrete areas of the web in directions substantially in the plane of the web whilst maintaining a proportion of fibres within those areas and adjacent said porous surface. The fibres that are not displaced from the discrete areas serve to bridge those areas and thus prevent the occurence of clear holes (as hereinafter defined).

Since the area of the aperture adjacent the web is greater than the area of the impinging fluid stream, there is a "void volume" within the passageway not occupied by the fluid stream. It is believed that this allows displaced fibres—which are subject to the constraints imposed by the walls of the passageways—to accumulate therein until a condition of mechanical equilibrium is achieved, thereby avoiding clear holes. Of course, it is not intended that the invention should be limited in any way by this hypothesis.

By "clear hole", there is meant an aperture or void in the web that is significantly larger than the normal interstices between the fibres constituting the non-woven web. In practice, a "clear hole" is such an aperture or void which would permit passage therethrough of fine particles ("dust") from the intended contents of an infusion pouch made from the fabric. In the case of paper for infusion pouches, the invention makes it possible to achieve a fabric which contains substantially no apertures or voids exceeding 450 microns in breadth. The upper limit for apertures or voids extending 450 microns in breadth is realistically set, by means of the invention, at 7% (preferably 2%) of the apertures or voids in the machine direction of the fabric, and 7% (preferably 2%) in the cross direction.

The web of non-woven fabric produced by means of the present invention can be described as having a pattern defined by an array of discrete areas having a fibre density (i.e. fibres per unit area) less than that of the web extending between said discrete areas, said discrete areas being substantially free of clear holes (as hereinbefore defined).

BRIEF DESCRIPTION OF THE DRAWINGS

FIG. 1 is a diagrammatic side cross-section of an exemplary apparatus for producing a patterned fabric in accordance with the present invention;

FIG. 4 is a schematic representation of the proposed mechanism by which the pattern is produced in a non-woven fabric web in accordance with the present invention;

DESCRIPTION OF THE PREFERRED EMBODIMENTS

Figure 2:
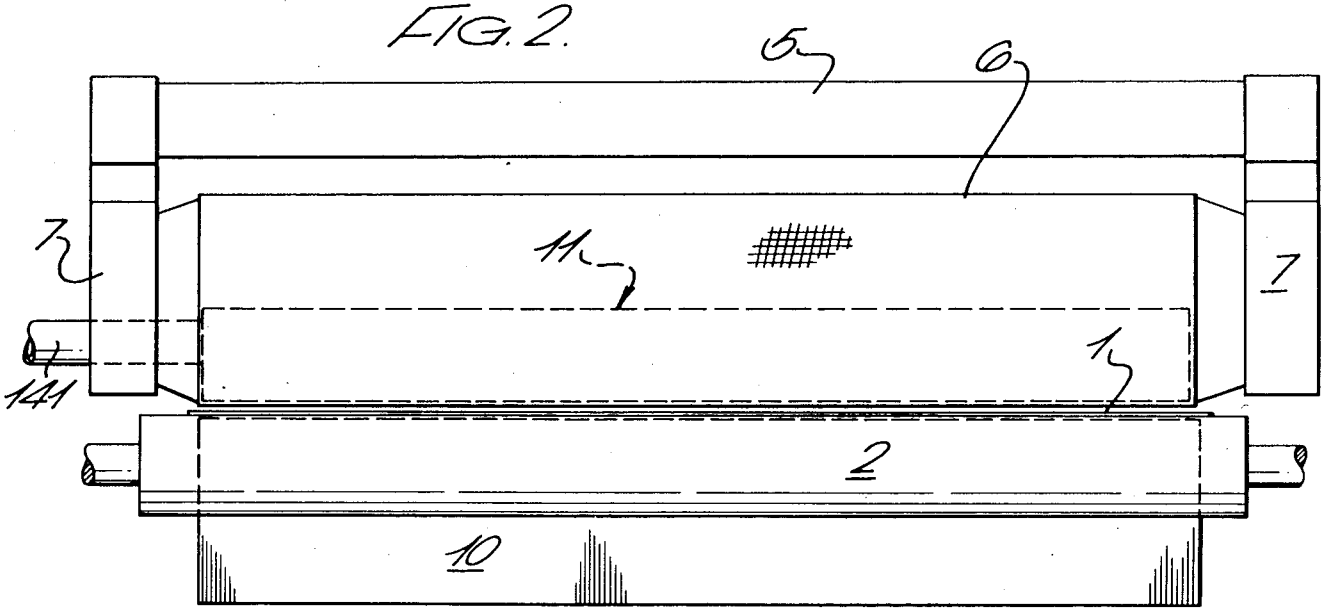
FIG. 2 is a longitudinal view of the means for producing fluid streams within the machine of FIG. 1.

The non-woven fabrics employed in the practice of the present invention can be manufactured from any of the fibres customarily used in the production of non-woven filtering media, for example fibres derived from wood, abaca or rayon. Mixtures of fibres can be used and it is also possible to have heat-sealable fibres either admixed with the base fibres or formed as a distinct phase on the base phase. The fibres will typically have lengths in the range from 0.1 mm to 40 mm.

Best results are obtained using a wet web, especially a freshly wet-laid web, although in principle it is possible to use webs formed by other methods, for example air-laid webs.

The means defining the porous surface can be, for example, a perforated or otherwise foraminous sheet or plate; however, it is conveniently a mesh formed of strands of either metal (e.g. bronze) or a plastics material. The mesh can, for example, be woven or knitted. The preferred means is a conventional Fourdrinier papermaking wire.

The fluid used in the streams (also referred to herein as "jets") is generally a liquid and is preferably an aqueous liquid, especially water. In the case of liquid streams, additives may be employed in order to achieve a desired viscosity.

To employ the method of this invention in a continuous manner, any appropriate means may be utilized to provide relative movement between the web and the fluid streams impinging thereon. In preferred embodiments, the web is continuously advanced through the zone in which the fluid streams act; this may be easier to arrange than the converse system wherein the apertured member is moved along a stationary web.

In order to obtain a clear pattern, it is preferred that the fluid streams should impinge upon the web in a single line across its width (i.e. in the cross direction). It is also preferred that the fluid streams should impinge upon the web in a series of pulses.

In principle, it is possible to utilize a perforated sheet or plate as the apertured member. However, in preferred embodiments, a perforated or apertured, hollow cylinder is employed. Such a cylinder is advantageously supported over a continuously advancing porous support member for the non-woven web, the longitudinal axis of the cylinder being arranged parallel to the porous support surface and transversely with respect to the direction of advance of the web. In other words, the cylinder is preferably supported for rotation about its longitudinal axis such that the outer surface of the cylinder comes into close proximity and approaches tangentially to said porous surface. The web passes between the apertured cylinder and the porous surface.

As mentioned above, the method of the present invention involves the use of jets of fluid to displace only a proportion of the fibres within discrete areas. One means of ensuring that a proportion of fibres is retained in position within said discrete areas is to form the passageways in the apertured member so that they are "flared", i.e. they increase in cross-sectional area in the direction from the second surface to the first surface (this being also the direction of flow of the jets in the passageways). The increase in area may be linear or non-linear.

Another means for achieving the requisite partial displacement of the fibres within the discrete areas is to generate the fluid streams or jets such that each has a cross-section that is smaller in area than the area of the corresponding aperture in the second surface. With such a fluid stream, it would be possible to utilize, say, a passageway with a constant cross-sectional area and still have the "void volume" referred to above. However, it can be advantageous to utilize such fluid streams in combination with the flared passageways described in the previous paragraph.

The references to the cross-sectional area of a stream of fluid relate in general to the cross-section of the stream immediately after entry into the respective passageway.

It is also preferred to apply a vacuum to the web through the porous support member, particularly to a region of the web in register with the region against which the fluid jets impinge. The vacuum helps to retain fibres adjacent the porous support member (which fibres may become temporarily lodged within the interstices of the support member), whereby said fibres resist to a certain extent the disturbing action of the fluid jets.

The fluid is conveniently supplied to the apertures by means of a device that directs a sheet (or "curtain") of fluid, preferably under pressure, to the said second surface of the member, i.e. the face of the apertured member remote from the web and from the porous support member. Vacuum means and/or wiping means may be provided in order to remove the excess or surplus fluid, i.e. that which does not pass through the apertures.

Turning now to the accompanying drawings, the apparatus shown in FIGS. 1 and 2 comprises a support wire 1 which is continually advanced over rollers 2 and 3 in the machine direction indicated by arrow 4. The rate of advance may be, for example, from 4 to 415 meters per minute. In operation a fibrous web produced at a down-stream location (not shown) is fed onto the support wire, which wire is preferably a standard Fourdrinier paper-making wire.

A gantry assembly indicated generally by 5 (see FIG. 2) supports an apertured member in the form of a hollow metal cylinder 6. The cylinder is mounted at each end in bearings 7 for rotation about the longitudinal axis of said cylinder 6. During operation, the cylinder 6 will rotate in the clockwise direction as viewed in FIG. 1 and as indicated by arrow 8. If required, the cylinder can be positively driven by appropriate means (not shown).

A vacuum system 10 is provided to supply vacuum to the underside of the support wire in the region 9.

Arranged within the apertured cylinder 6 is a "fluid knife" device 11, which device is adapted to direct a curtain of fluid perpendicularly to the internal surface 13 of the cylinder 6 in the region 9. The fluid knife 11 extends substantially along the length of the cylinder so that fluid jets will be directed against the supported fabric web along substantially its entire width, in the manner described hereinafter.

The fluid knife 11 comprises a reservoir 14 for high pressure fluid, which is supplied to the system through conduit 141. The fluid under pressure passes from the reservoir 14 through a conduit 15 to a slot 16 from which the curtain of fluid 12 emerges. When the fluid is water, a flow rate of 2 to 20 $m^3$ per meter of machine width per hour has been found to be satisfactory. The width of the slot is preferably from 25 $\mu m$ to 80 $\mu m$ and is typically about 50 $\mu m$.

Associated with the fluid knife 11 is a vacuum system 17 in which a vacuum (for example, of 50 to 330 mm Hg) is drawn via a vacuum slot 18. The vacuum system 17 serves to draw up surplus or excess fluid (i.e. the fluid from the fluid curtain 12 that does not pass through the apertures in the cylinder 6); by this means, flooding of the system is avoided. The excess fluid drawn up by the vacuum system 17 can be discharged via any appropriate means (not shown).

Figure 3:
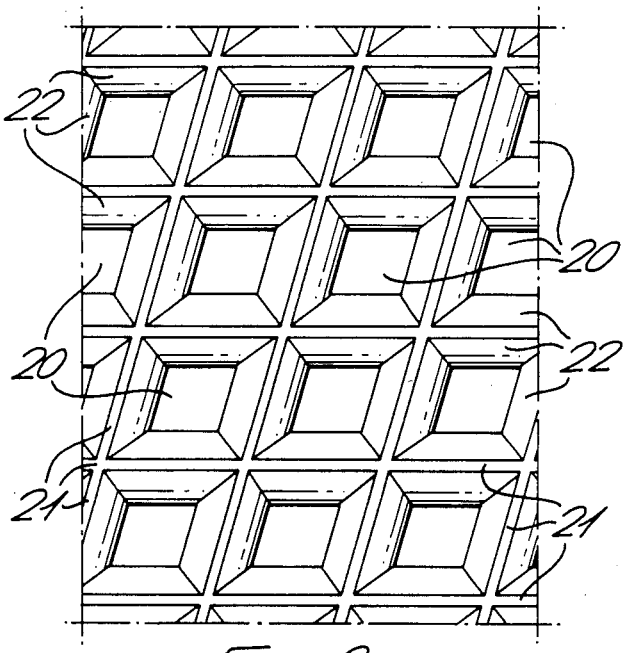
FIG. 3 is an enlarged fragmentary elevation of the outer surface of an apertured cylinder employed in the machine of FIG. 1 to produce the streams of fluid.

As indicated in FIGS. 3 and 4, the outer surface 21 of the cylinder or roll 6 is provided with a regular array of apertures 20 communicating with corresponding apertures in the inner surface 13 by means of passageways 22. The apertures 20 in the outer surface 21 of the cylinder 6 can be of any desired shape, for example square, rectangular, diamond-shaped, oval, circular or star-shaped. The walls of the passageways 22 diverge in the direction from inner surface 13 to outer surface 21. Thus, the area of each aperture 20 in the outer surface 21 is greater than the area of the corresponding aperture at the inner surface 13.

The fluid curtain 12 may, in some embodiments, have a thickness (determined by the width—i.e. the dimension in the machine direction—of the slot 16) greater than the machine-direction dimension of the apertures in the inner surface 13 of the cylinder 6. In such cases, the fluid curtain 12 will strike the inner surface 13 of the cylinder 6 and a proportion of the fluid will pass into the passageways 22 in the form of discrete streams or jets. The cross section of each jet will then be determined by the area of the respective aperture in the inner surface 13.

However, it is preferred that the width of the fluid curtain be less than the dimension, in the machine direction, of the apertures in the inner surface 13. Thus, as clearly shown in FIG. 4, there is a void space between the fluid stream or jet 24 and the diverging side walls of the passageway 22. As illustrated in FIG. 4, the passageways 22 are perpendicular to the surface of the porous support 1 in the zone in which the fluid streams 24 impinge on the web.

Generally, the edge of each aperture 20 in the 'zone of influence' 9 will be in contact with the web. In other words, the passageways 22 through which the fluid jets 24 directed are sealed off by the web. During operation, and again as shown in FIG. 4, it appears that the impinging jet 24 displaces a proportion of the fibres in web 25, the displaced fibres tending to accumulate as at 26 in the void spaces 23. As mentioned, it is thought that the displacement of fibres proceeds until a mechanical equilibrium is achieved with respect to the displaced and accumulated fibres. At the point of equilibrium, fibres within the areas covered by apertures 20 are retained in position to give discrete areas 27 having a reduced fibre density compared with the web in the regions between the areas impinged upon by the fluid jets. The areas of reduced fibre density retain the integrity associated with the untreated web and are therefore free of the clear holes produced in the prior-art methods owing to the passage of the fluid jets completely through the web (British Pat. No. 836,397), or owing to the breakthrough of wire knuckles (British Pat. No. 1,102,246).

The vacuum applied to the web through the Fourdrinier wire 1 by means of the lower vacuum system 10 can aid in maintaining the integrity of the web in the areas 27 by lodging the fibres within the interstices of the Fourdrinier wire. The vacuum applied may be, for example, from 50 to 330 mm Hg.

The vacuum system 10 also acts to remove the fluid supplied as jets after the latter have caused fibre displacement. This removal is important in order to avoid further, unwanted disruption of the fibres.

Since the cylindrical roll 6 rotates in concert with wire 1 and the supported web 25, and since the outer surface 21 parts cleanly from the web as the latter moves out of the region 9, there is no disruption of the fibres, as would otherwise be caused if there were relative movement of the cylinder and the web.

It will be appreciated that, as the drum rotates, any given part of the fluid curtain 12 will periodically strike solid areas of the inner surface 13 instead of entering a passageway 22. Thus, the fluid jets 24 are formed intermittently or as a series of pulses; this determines at least in part the distribution or pattern in the treated web if the areas of lower fibre density. With a circumferential speed of 200 m/minute, a typical apertured drum 6 of 12 inch (30.48 cm) diameter has been calculated to interrupt the fluid curtain 12, at any given position, at a rate of 1462 times per second.

The dimensions of the apertures 20 will generally be from 0.1 mm to 10 mm, for instance from 1 mm to 5 mm. By way of example, a cylinder 6 has been used having a thickness of 0.36 mm and passageways of rectangular cross-section. The apertures 20 in the outer surface 21 were 1.78×2.39 mm and those in the inner surface 13 were 1.10×1.71 mm, the longer dimension in each case being in the machine direction. In apertures 20 were 0.34 mm apart in the machine direction and 0.50 mm apart in the cross direction.

In another exemplary cylinder 6, of 0.40 mm thickness, the apertures were each in the shape of a rhombus (FIG. 3), arranged with the longer diagonal in the machine direction. The diagonals of the apertures in the inner surface were measured at 0.90 and 1.24 mm, from which the rhombus sides were calculated to be 0.77 mm. The sides of the apertures 20 were found to be 1.57 mm, the acute angles of the rhombus being about 70° or 71°. The centres of adjacent apertures were 2.57 mm apart in the machine direction and 2.00 mm apart in the cross direction.

In general the ratio of the area of each aperture 20 to the area of the corresponding aperture in surface 13 is from 1.25 to 8, for example from 2 to 5.

Figure 5:
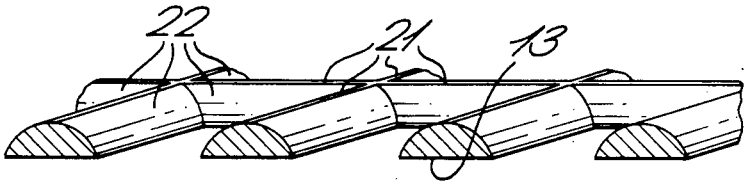
FIG. 5 is a sectional view through an apertured cylinder similar to that shown in FIG. 3.

In FIG. 5, an alternative construction of the apertured cylinder 6 is shown, in which the walls defining the passageways 22 have a curved profile. However, the walls still define a flared passage for the fluid jets 24.

The invention is applicable to the production of patterned non-woven webs from a variety of fibres. However, when the fluid is, or comprises, water it is preferred that the web-forming fibres shall contain a significant proportion (preferably 20% to 100% by weight) of hydrophilic fibres, which will become plasticized in aqueous solution and will thus be more readily enmeshed in the interstices of the porous surface. The basis weight of the patterned product can vary widely, a suitable range being from 8 to 65 gsm (grams per square meter).

The apertured roll assembly, in order that it shall be capable of continuous operation at high speed, should be constructed of a rigid material, for example nickel. This rigidity is desirable to ensure that the resulting product has a uniform pattern despite the forces exerted on the cylinder due to its rotation and due to the application of the high pressure fluid. The thickness of the cylinder wall may be, for example, from 0.1 mm to 2 mm, preferably 0.15–0.7 mm and especially 0.35–0.4 mm. The outer surface 21 of the cylinder should also be sufficiently smooth to prevent the undesirable accumulation of fibrous material which may lead to the blockage of the apertures 20.

It is desirable for the perforated cylinder 6 to remain a constant distance from the support wire in order to achieve uniformity of the resulting product. This distance is dependent upon the degree of bridging (i.e. the extent of the web areas connecting the areas of reduced fibre density) that is required and also on the nature of the web itself. The optimum position of the cylinder 6 is such that the outer surface 21 of the cylinder 6 is close to (generally within one-eighth inch or 3 mm) or in contact with the top surface of the fibrous web, which web is preferably in a wet condition. If the gap between the cylinder 6 and the support wire 1 is too narrow, the stock or web will be compressed and this may hinder the effective displacement of the uppermost fibres. If, on the other hand, the gap is too large the resulting product may become diffuse (i.e. it may have an ill-defined pattern structure or possibly no pattern at all) as the zone of influence of the fluid jets becomes less effective.

The practice of the present invention is illustrated in the following Example.

EXAMPLE 1

A typical freshly wet laid teabag web, at 17 gsm (air dry), comprising abaca fibre 35%, wood pulp fibre 40% and synthetic, heatseal fibre 25% by weight, was supported on a synthetic, Fourdrinier-type wire with a count of 87 strands per inch for the warp and 72 strands for the weft. This web was fed into the "zone of influence" (region 9) of the apparatus, shown diagramatically in FIGS. 1 and 2. The web had an approximate consistency of 20% fibre and 80% water immediately before entering region 9. A vacuum of 288 mm of mercury was applied via vacuum box 10, and a similar vacuum applied via slot 18. The perforated cylinder possessed apertures with a count of 32 per square cm in each direction. The dimensions of these apertures were $0.7\times1.0$ mm when viewed from the inner surface of the cylinder and were tapered from the external surface to give an aperture approximately 50% larger at the outer surface of the cylinder.

Figure 7:
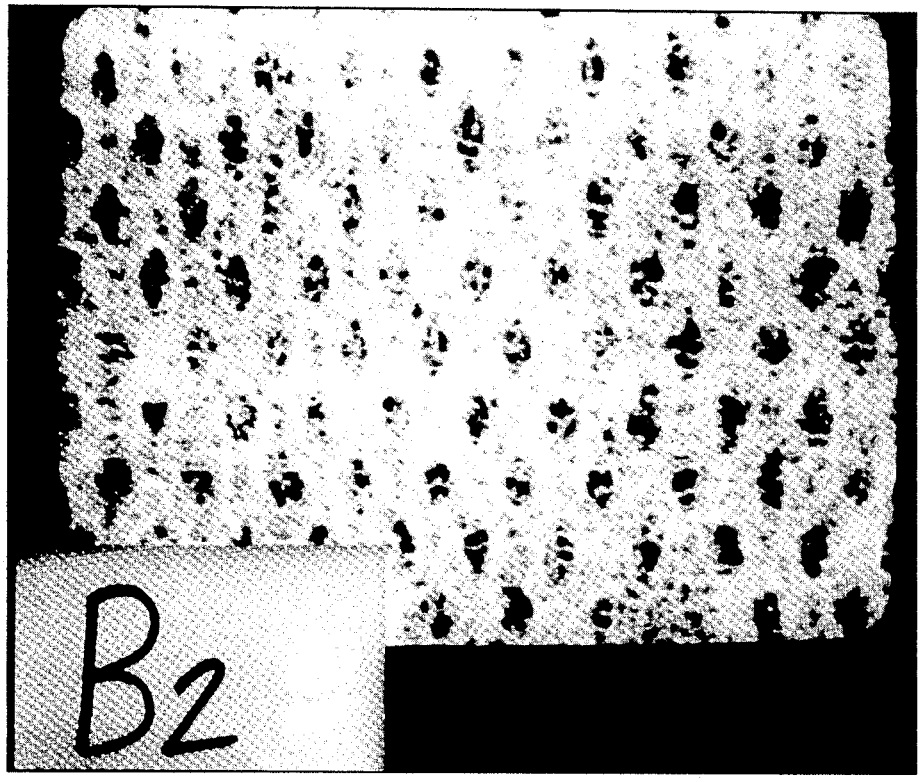
Figure 8:
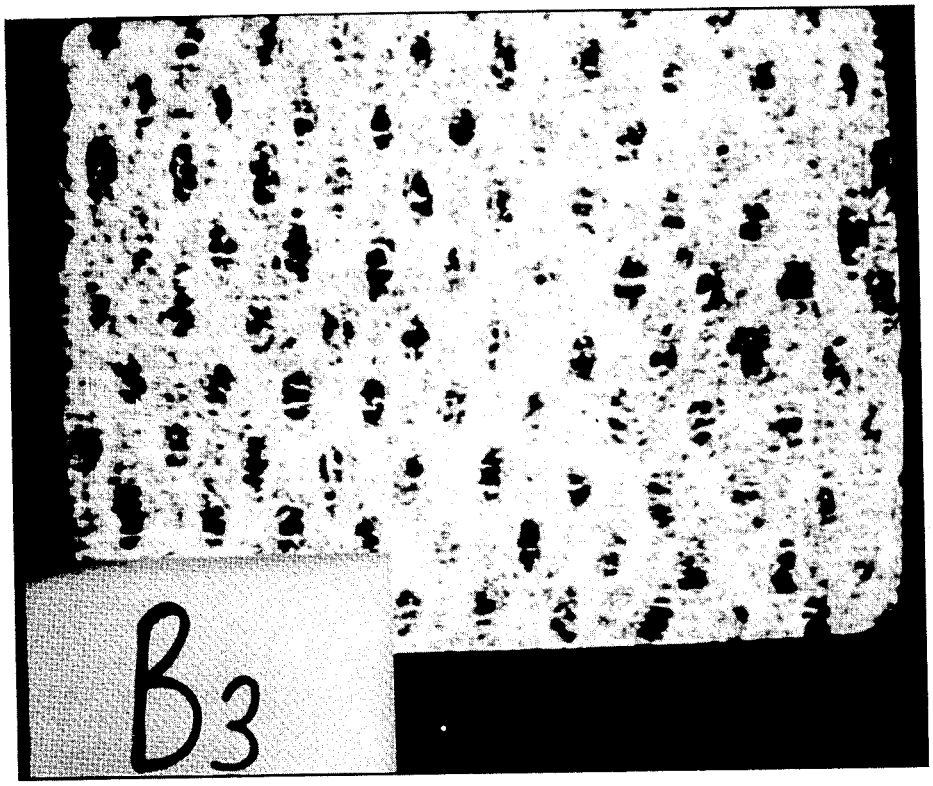
Figure 9:
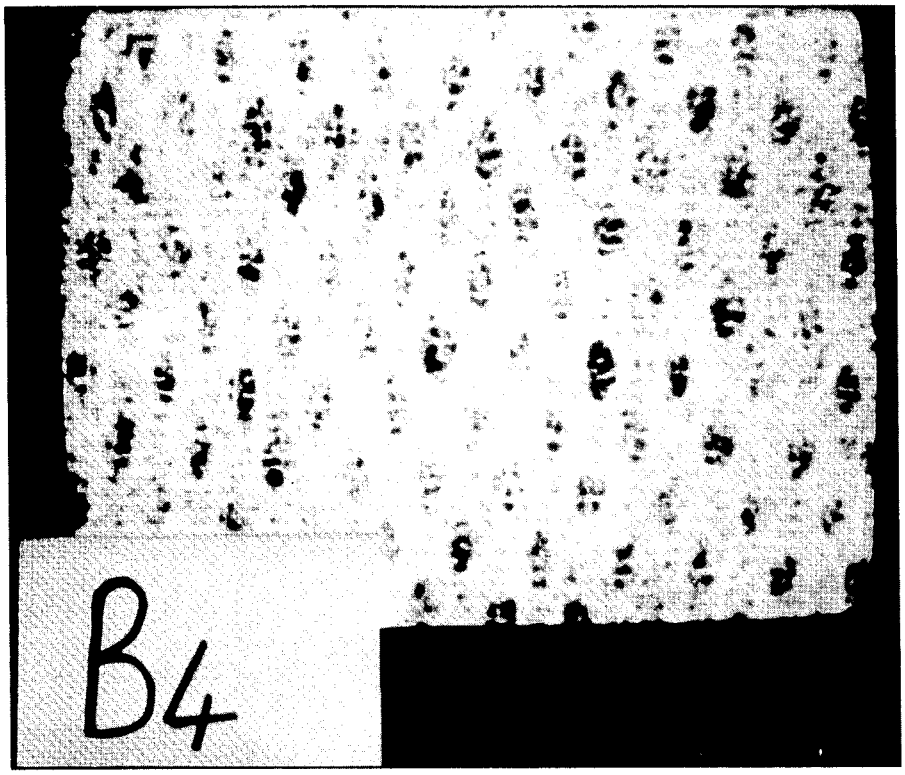

A range of products were made by varying the flow of the fluid, in this case water at 10° C., in the range of 2–12 cubic meters per meter width of the web per hour. The resultant products, after drying, are shown in photographs $B_2$, $B_3$ and $B_4$ (FIGS. 7, 8 and 9).

In Tables 1 and 2 which follow, there can be seen the comparative results of the pore size distribution for the webs, as measured by an optical image analyser, and the percentage sifting of tea dust by the webs when subjected to a tea sifting test using commercial tea. The pore size distribution results listed in Table 1 give the frequency of holes measured at particular chord lengths. The sifting list records the percentage of tea which passes through the web compared with the amount passing a standard wire mesh sieve.

It will be noted that the incidence of apertures having a breadth greater than 450 microns in web $B_3$ is 6.2% in the cross-direction (CD) and 9.4% in the machine direction (MD), which is higher than is acceptable for use in infusion pouches. This is verified by the comparatively high seepage figure for this web (see Table 2). The incidence of clear holes (breadth $>$ 450 microns) in web $B_2$ is 6.9% (CD) or 6.5% (MD); in web $B_4$ the incidence of such clear holes is 0.5% (CD) or 1.7% (MD), which is reflected in the excellent tea-dust retention result.

The results clearly show that a web of "controlled open-ness" can be produced without the generation of gross holes corresponding to the aperture size in the cylinder.

Figure 6:
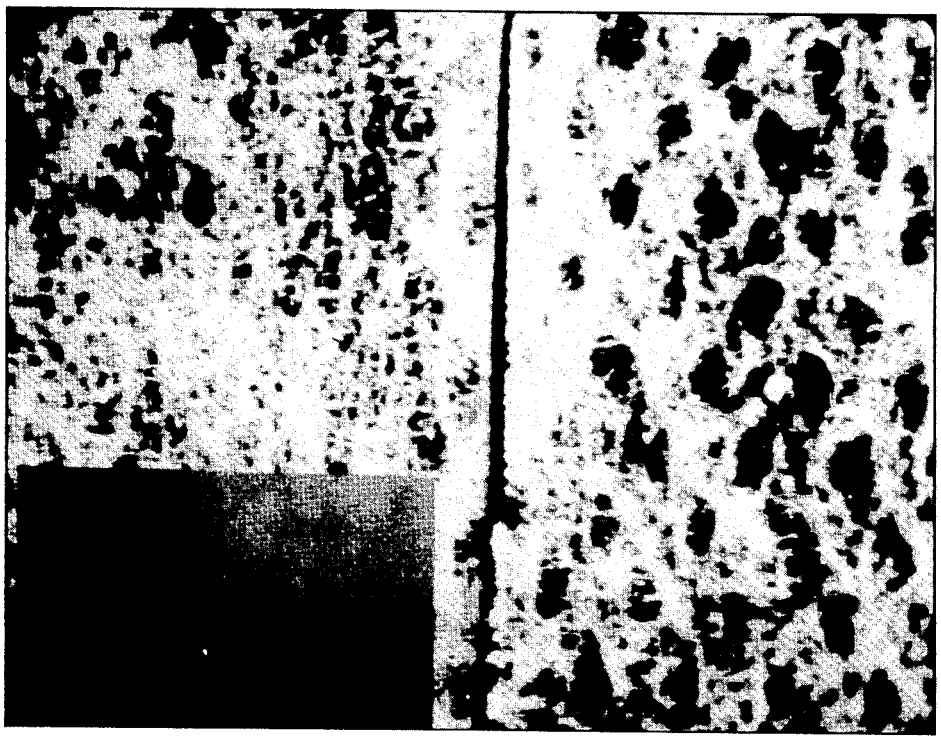
FIGS. 6 to 9 are each a photomicrographic view of a sample of patterned teabag paper.

To illustrate the invention further, the web, examples of which are shown in photographs $B_2$, $B_3$, and $B_4$, was subjected to a sheet splitting process which divides the web along its thickness approximately into halves. The photograph $A_1$ shows clearly that the top half of the web possesses distinct holes whereas the lower half of the web, which is supported on the porous wire, is undisturbed (see FIG. 6).

TABLE 1

| Chord Size Limits | Pore Frequency/Cross Direction | | | Pore Frequency/Machine Direction | | |
|---|---|---|---|---|---|---|
| (microns) | Sample $B_3$ | Sample $B_2$ | Sample $B_4$ | Sample $B_3$ | Sample $B_2$ | Sample $B_4$ |
| 28 | 471 | 369 | 315 | 493 | 399 | 331 |
| 84 | 645 | 460 | 459 | 628 | 557 | 472 |
| 140 | 1144 | 823 | 807 | 1135 | 960 | 824 |
| 196 | 1307 | 993 | 794 | 1659 | 1135 | 980 |
| 252 | 812 | 674 | 418 | 1043 | 722 | 425 |
| 308 | 506 | 319 | 178 | 558 | 415 | 219 |

TABLE 1-continued

| Chord Size Limits (microns) | Pore Frequency/Cross Direction | | | Pore Frequency/Machine Direction | | |
|---|---|---|---|---|---|---|
| | Sample $B_3$ | Sample $B_2$ | Sample $B_4$ | Sample $B_3$ | Sample $B_2$ | Sample $B_4$ |
| 364 | 317 | 275 | 82 | 361 | 271 | 108 |
| 420 | 301 | 212 | 38 | 319 | 238 | 77 |
| 476 | 140 | 119 | 11 | 232 | 112 | 30 |
| 532 | 83 | 76 | 4 | 132 | 81 | 12 |
| 588 | 66 | 54 | 1 | 98 | 53 | 13 |
| 644 | 50 | 45 | 0 | 67 | 40 | 4 |
| 700 | 16 | 7 | 0 | 47 | 27 | 1 |
| 756 | 7 | 4 | 0 | 26 | 10 | 0 |
| 812 | 3 | 1 | 0 | 26 | 5 | 0 |
| 868 | 2 | 0 | 0 | 13 | 2 | 0 |
| 924 | 0 | 0 | 0 | 4 | 0 | 0 |
| 980 | 0 | 0 | 0 | 2 | 0 | 0 |
| 1036 | 0 | 0 | 0 | 1 | 0 | 0 |

Pore frequency, machine direction and cross direction, is 0 in each case for samples $B_3$, $B_2$, $B_4$ at chord size limits (microns) of 1092, 1148, 1204, 1260, 1316, 1372, 1428, 1484 and 1540.

Gross aperture, internal dimensions:
Cross direction: 700 μm
Machine direction: 1000 μm.

TABLE 2

| TEA DUST RETENTION CHARACTERISTICS | |
|---|---|
| | % Seepage |
| Sample $B_3$ | 130 |
| Sample $B_2$ | 80 |
| Sample $B_4$ | 35 |

Modifications and variations of the illustrative embodiments are of course possible within the scope of the present invention. For instance, it may be desirable to have areas of the outer surface of the cylinder that are free of apertures. Thus, it is possible to block off an area of, say, 1 $cm^2$, in the shape of a letter or other symbol. This imparts an image of that symbol to the web surface, for example for decorative or identification purposes.

Determination of suitable values of the variable parameters—e.g. the machine speed, the degree to which the passageways 22 are flared, or the fluid pressure—can be readily carried out by the skilled person for any given case.

We claim:

1. An apparatus for producing a patterned non-woven fabric, which apparatus comprises means defining a porous surface for supporting a non-woven web; an apertured member having a first surface adjacent the porous surface and a second surface remote from the porous surface, the first surface having apertures therein each communicating with a respective aperture in the second surface by means of a passageway extending therebetween; and means for directing a sheet of fluid at the second surface of the apertured member and thereby form discrete streams of fluid in respective passageways in the apertured member in the direction from the second surface to the first surface, characterized in that the apertured member is provided with passageways that increase in cross-sectional area as they lead to their respective apertures in the first surface of the apertured member and in that the means for directing a sheet of fluid at the second surface is provided with a slot through which the sheet of fluid issues with a thickness less than the corresponding dimension of the apertures in the second surface of the apertured member.

2. An apparatus according to claim 1, characterised in that means are provided for applying a vacuum through the porous surface in a region opposite the passageways through which the fluid streams pass.

3. An apparatus according to claim 1, characterized in that the said passageways are perpendicular to the porous surface in the zone in which the fluid streams impinge upon the web.

4. An apparatus according to claim 1, characterized in that the said slot has a thickness of from 25 μm to 80 μm; the dimensions of the apertures in the said first surface are from 0.1 mm to 10 mm; the ratio of the area of each aperture in the first surface to the area of the corresponding aperture in the second surface is from 1.25:1 to 8:1; and the apertured member has a thickness of from 0.1 to 2 mm.

5. An apparatus according to claim 1, characterized in that the said first surface is substantially smooth.

6. An apparatus according to claim 1, characterized in that means are provided for advancing in a given direction the means defining the supporting porous surface, the apertured member being in the form of a hollow cylinder supported for rotation about its longitudinal axis, which axis is arranged parallel to the said porous surface and transverse to the said given direction.

7. An apparatus according to claim 6, characterised in that vacuum means are provided for removing any surplus fluid from within the cylinder.

8. An apparatus according to claim 6, characterized in that the said passageways are perpendicular to the porous surface in the zone in which the fluid streams impinge upon the web.

9. An apparatus according to claim 6, characterized in that the said slot has a thickness of from 25 μm to 80 μm; the dimensions of the apertures in the said first surface are from 0.1 mm to 10 mm; the ratio of the area of each aperture in the first surface to the area of the corresponding aperture in the second surface is from 1.25:1 to 8/;1; and the apertured member has a thickness of from 0.1 to 2 mm.

10. An apparatus according to claim 6, characterized in that the said first surface is substantially smooth.

11. An apparatus according to claim 6, characterized in that the slot is arranged transversely to the said given direction.

12. An apparatus according to claim 6, characterized in that the slot is arranged to direct a sheet of fluid perpendicularly to the said second surface of the apertured member.

13. An apparatus according to claim 12, characterized in that the said passageways are perpendicular to the porous surface in the zone in which the fluid streams impinge upon the web.

* * * * *

UNITED STATES PATENT AND TRADEMARK OFFICE

CERTIFICATE OF CORRECTION

PATENT NO. : 4,666,390

DATED : May 19, 1987

INVENTOR(S) : Kenworthy et al

It is certified that error appears in the above-identified patent and that said Letters Patent is hereby corrected as shown below:

At the bottom of Column 10, add the following claim:

14. An apparatus according to claim 1 characterised in that the means defining a porous surface is a Fourdrinier papermaking wire.

Signed and Sealed this

Third Day of November, 1987

*Attest:*

DONALD J. QUIGG

*Attesting Officer*

*Commissioner of Patents and Trademarks*